US008514039B1

(12) United States Patent
Yamane et al.

(10) Patent No.: US 8,514,039 B1
(45) Date of Patent: Aug. 20, 2013

(54) ELECTRIC RELAY

(71) Applicants: Yasuyuki Yamane, Chiyoda-ku (JP); Katsunori Yagi, Chiyoda-ku (JP); Hayato Yamauchi, Chiyoda-ku (JP)

(72) Inventors: Yasuyuki Yamane, Chiyoda-ku (JP); Katsunori Yagi, Chiyoda-ku (JP); Hayato Yamauchi, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/718,675

(22) Filed: Dec. 18, 2012

(30) Foreign Application Priority Data

May 17, 2012 (JP) ..... 2012-113491

(51) Int. Cl.
*H01H 67/02* (2006.01)

(52) U.S. Cl.
USPC ..... 335/126

(58) Field of Classification Search
USPC ..... 335/126
See application file for complete search history.

(56) References Cited

U.S. PATENT DOCUMENTS

| | | | | | |
|---|---|---|---|---|---|
| 5,132,653 | A * | 7/1992 | Nakatake et al. | ..... | 335/202 |
| 5,245,304 | A * | 9/1993 | Zenmei | ..... | 335/126 |
| 5,643,693 | A * | 7/1997 | Hill et al. | ..... | 429/121 |
| 5,663,699 | A * | 9/1997 | Shiroyama | ..... | 335/126 |
| 5,694,100 | A * | 12/1997 | Jacquet et al. | ..... | 335/120 |
| 5,939,960 | A * | 8/1999 | Godel et al. | ..... | 335/126 |
| 6,269,706 | B1 * | 8/2001 | Kuragaki et al. | ..... | 74/7 A |
| 7,639,108 | B2 * | 12/2009 | Miyake | ..... | 335/126 |
| 7,728,704 | B2 * | 6/2010 | Schmidt et al. | ..... | 335/126 |
| 8,138,872 | B2 * | 3/2012 | Yoshihara et al. | ..... | 335/281 |
| 8,154,366 | B2 * | 4/2012 | Schmidt et al. | ..... | 335/126 |

FOREIGN PATENT DOCUMENTS

JP 10-018949 A 1/1998

* cited by examiner

*Primary Examiner* — Alexander Talpalatski
(74) *Attorney, Agent, or Firm* — Sughrue Mion, PLLC

(57) ABSTRACT

An electric relay can easily conform to a specification change so as to improve layouting and at the same time to avoid an increase in cost. An electric relay (30) is composed of a relay main body (1), which is provided with caps (7) which is formed of a non-conductive member, and in the interior of which an electrical contact and an exciting coil are arranged, and a connector (20), which is provided with a terminal connection part (25) and a bush (24) which are integrally molded with a non-conductive member (21), wherein the terminal connection part (25) and the bush (24) of the connector (20) are mounted on an exciting terminal (2) and a main terminal (3) of the relay main body (1).

7 Claims, 3 Drawing Sheets

ELECTRIC RELAY

BACKGROUND OF THE INVENTION

1. Field of the Invention

The present invention relates to an electric relay used for a starter relay, etc., which is mounted on a vehicle, and in particular, to an electric relay used for turning on and off an electric current in a vehicle side power supply system, for example.

2. Description of the Related Art

In general, in the case of starting an engine for a vehicle, electric power is supplied to a switch coil of a starter in order to start the starter.

At this time, there has been applied a technique in which an electric current supplied from a vehicle side power supply system to the switch coil is relatively large, so the electric current is not directly supplied to a starter switch, but instead, by the use of an electric relay (a starter relay), a small electric current from a vehicle side is caused to flow to an exciting coil of the electric relay so that a fixed contact member of the electric relay is closed, thereby supplying an electric current from the power supply for a vehicle to the starter switch (for example, refer to a first patent document).

Here, in cases where a connector is to be mounted on an exciting terminal of the exciting coil in order to improve the connection workability and the environmental resistance of the exciting terminal of the exciting coil, when the connector (connector with one pole) connected only to an upstream side of the exciting coil of a relay main body is used, it is necessary to fasten the connector by screws from a rear side of the exciting terminal, or it is necessary to set for exclusive use a member which is composed of the connector and a cap of the relay main body which are integrally formed with each other.

However, in cases where the connector is fixedly secured to the exciting terminal of the relay main body by means of the screws, the connector is supported on the relay main body only through the exciting terminal, and hence becomes very unstable.

In addition, in the case of an integral-type electric relay having a connector and a cap formed integral with each other, it is necessary to provide the cap for exclusive use for each connector, and the cost for production thereof becomes high.

In addition, in cases where a connector (connector with two poles) connected to both an upstream side and a downstream side of an exciting coil of a relay main body is used, it is necessary to pull out a lead wire from an exciting terminal, to arrange the connector at a tip end of the lead wire, and to fixedly secure the connector to an arbitrary position at the side of a vehicle.

In this case, because it is necessary to fixedly secure the connector with the lead wire to the arbitrary position at the side of the vehicle, the layouting of the connector is difficult, thus giving rise to an increase in cost.

PRIOR ART REFERENCES

Patent Documents

First Patent Document: Japanese patent application laid-open No. H10-018949

SUMMARY OF THE INVENTION

With the conventional electric relay in the technique described in the first patent document, there has been a problem that when the connector is fixedly secured or attached to the exciting terminal of the relay main body by means of the screws, there occur deformation of the exciting terminal, loosening of the screws, etc., and hence, the fixed attachment of the connector and the exciting terminal becomes unstable.

In addition, in order to avoid this problem, the member, in which the connector and the cap of the relay main body are integrally formed with each other, may be set for exclusive use, but it is necessary to set the cap formed integrally with the connector for exclusive use according to the shape of each terminal or layout, thus giving rise to a problem that high production cost is caused.

Further, in cases where the two-pole connector connected to both the upstream side and the downstream side of the exciting coil of the relay main body is used, it is necessary to pull out the lead wire from an exciting terminal part, to arrange the connector at the tip end of the lead wire, and to fixedly secure the connector or lead wire to the arbitrary position at the side of the vehicle, and hence, there has been a problem that the layouting of the connector becomes difficult, and besides, it also leads to an increase in cost.

The present invention has been made in order to solve the problems as referred to above, and has for its object to obtain an electric relay which can be fixedly secured in a stable manner only by changing the shape of a connector without causing an increase in cost, by using a relay main body of a conventional structure as it is, and making it unnecessary to create a new cap so as to conform to each requirement.

An electric relay according to the present invention is composed of a relay main body, and a connector mounted on the relay main body. The relay main body is provided with a cap that is made of a non-conductive member and has an electrical contact arranged therein, an exciting terminal that is connected to an exciting coil which drives the electrical contact, and a pair of main terminals that are electrically connected to a fixed contact member of the electrical contact. The connector is provided with a non-conductive member, a connector terminal and a bush that are integrally molded with the non-conductive member, and a terminal connection part that is electrically connected to the connector terminal. The terminal connection part of the connector is fixedly secured to the exciting terminal of the relay main body, so that it is electrically connected to the exciting coil, and the bush of the connector is fixedly secured to one of the main terminals of the relay main body, so that it is electrically connected to the fixed contact element of the electrical contact.

According to the present invention, by changing the connector alone, it becomes possible to fixedly attach the electric relay in a stable manner at low cost, and besides, by mounting the connector with the use of one of the main terminals, it is possible to increase the creeping distance between the one main terminal and each component part, thus making it possible to achieve a specification which is excellent in leakage proofness.

In addition, in cases where a two-pole connector is used, too, it becomes possible to deal with such a situation only by providing an additional terminal connection part on a one-pole connector which is connected to an additional or another exciting terminal of the relay main body, and hence, an electric relay can be achieved which is excellent in the aspect of layout and cost.

The above and other objects, features and advantages of the present invention will become more readily apparent to those skilled in the art from the following detailed description of preferred embodiments of the present invention taken in conjunction with the accompanying drawings.

BEST MODES FOR CARRYING OUT THE INVENTION

First Embodiment

Hereinafter, a first embodiment of the present invention will be explained in detail while referring to the accompanying drawings.

Figure 1:
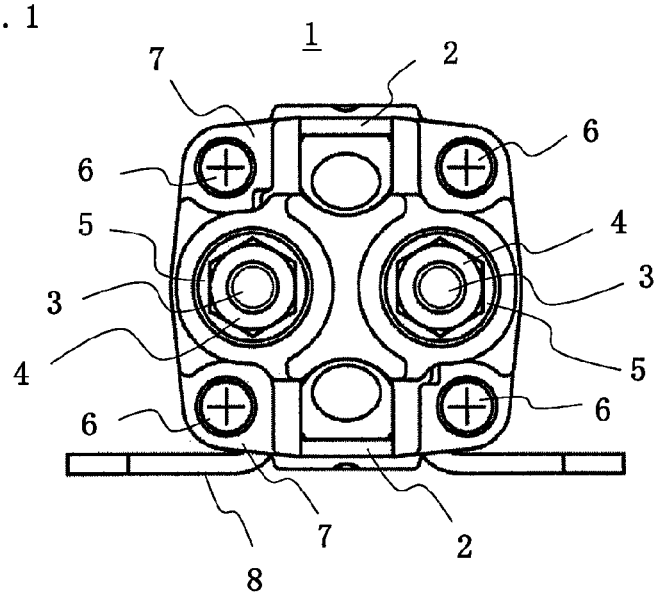
FIG. 1 is a front elevational view showing a relay main body to which a first embodiment of the present invention is to be applied.

FIG. 1 is a front elevational view showing a relay main body 1 to which the first embodiment of the present invention is to be applied, wherein a terminal part of a starter relay with a connector 20 (refer to FIG. 2) being not mounted thereon is shown.

In FIG. 1, the relay main body 1 is provided with a pair of exciting terminals 2 that are arranged on opposite side end faces thereof, respectively, a pair of main terminals 3 that are fixedly fastened by means of nuts 4 and SPL washers 5, a pair of non-conductive caps 7 that are fixedly fastened by means of screws 6, and a case 8.

An exciting coil (not shown) connected to the exciting terminals 2 is arranged in the interior of the relay main body 1.

In addition, electrical contacts (not shown) of the starter relay, which is driven by the exciting coil, are arranged in the interiors of the caps 7, respectively, and the main terminals 3 are electrically connected to fixed contact elements of the electrical contacts, respectively.

The exciting terminals 2 are fixedly secured to the caps 7, respectively, and at the same time are electrically connected to the exciting coil inside the relay main body 1.

The caps 7 are fastened to the case 8 by means of the screws 6, and the main terminals 3 are fixedly fastened to the caps 7 through the SPL washers 5 and the nuts 4, respectively.

Figure 2:
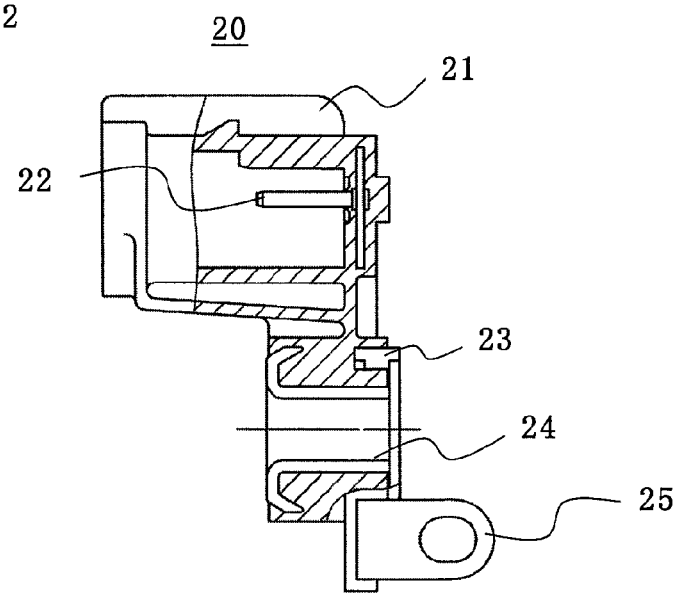
FIG. 2 is a side elevational view showing a connector according to the first embodiment of the present invention in a partial cross sectional view thereof.

FIG. 2 is a side elevational view showing the connector 20 according to the first embodiment of the present invention in a partial cross sectional view thereof.

In FIG. 2, the connector 20 is composed of a non-conductive member 21, a connector terminal 22 and a bush 24 which are arranged inside the non-conductive member 21, a packing 23 which is arranged in the periphery or surrounding of a bottom portion of the bush 24, and a terminal connection part 25.

The connector terminal 22 and the terminal connection part 25 are integrally formed with each other, or are formed separately from each other and are press fitted (or caulked) to each other, so that they are electrically connected to each other, thereby forming a metal component for supplying an excitation current to the exciting coil inside the relay main body 1. In addition, the connector terminal 22 and the terminal connection part 25 are integrally molded with the non-conductive member 21.

Here, note that the connector terminal 22 may be composed of a round pin type member for which electric connection can be easily made.

In addition, the bush 24 is integrally molded with the non-conductive member 21, or is press fitted into the non-conductive member 21, and is arranged in such a manner that a central axis thereof is in alignment with the central axis of the packing 23.

Here, note that the packing 23 made of an elastic member, which is non-conductive and has elasticity, is used as a sealing member between the bottom portion of the bush 24 and an upper surface of one of the caps 7 of the relay main body 1, but instead, a non-conductive sealing agent or compound may be coated on the surrounding of the bottom portion of the bush 24.

Figure 3:
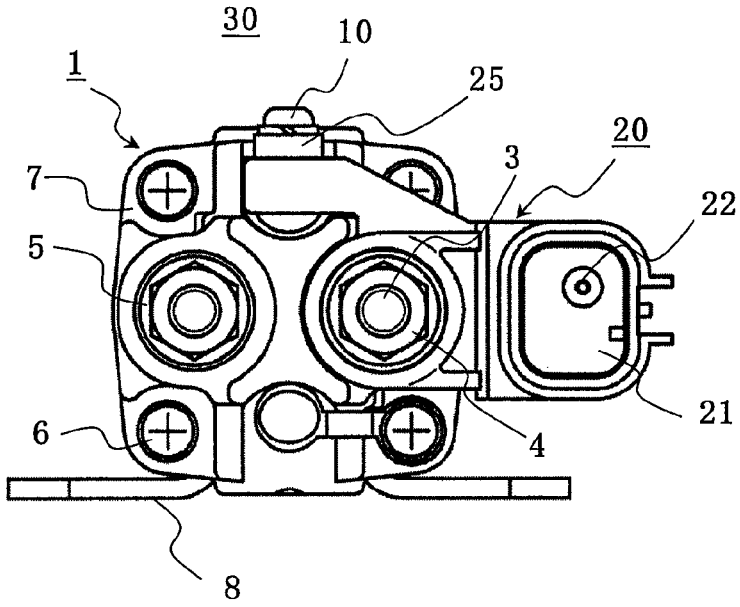
FIG. 3 is a front elevational view showing an electric relay according to the first embodiment of the present invention.

FIG. 3 is a front elevational view showing an electric relay (i.e., an electric relay 30 with one pole) according to the first embodiment of the present invention, wherein the connector 20 of FIG. 2 which is connected to the relay main body 1 of FIG. 1 is shown.

In FIG. 3, the terminal connection part 25 of the connector 20 is connected with the exciting terminals 2 of the relay main body 1 by means of a screw 10.

Moreover, the bush 24 of the connector 20 is inserted over one of the main terminals 3 of the relay main body 1, and is connected and fixedly fastened thereto by means of a nut 4. Here, note that the thickness of the bush 24 is set to be equal to or more than 3 mm, in order to obtain a sufficient creeping distance between the one main terminal 3 and each electrical connection component part.

As a result of this, the connector terminal 22 is electrically connected to one of the exciting terminals 2 of the relay main body 1 (starter relay).

In addition, the bush 24 is electrically connected to the fixed contact member of the relay main body 1 (starter relay) through the one main terminal 3.

Figure 4:
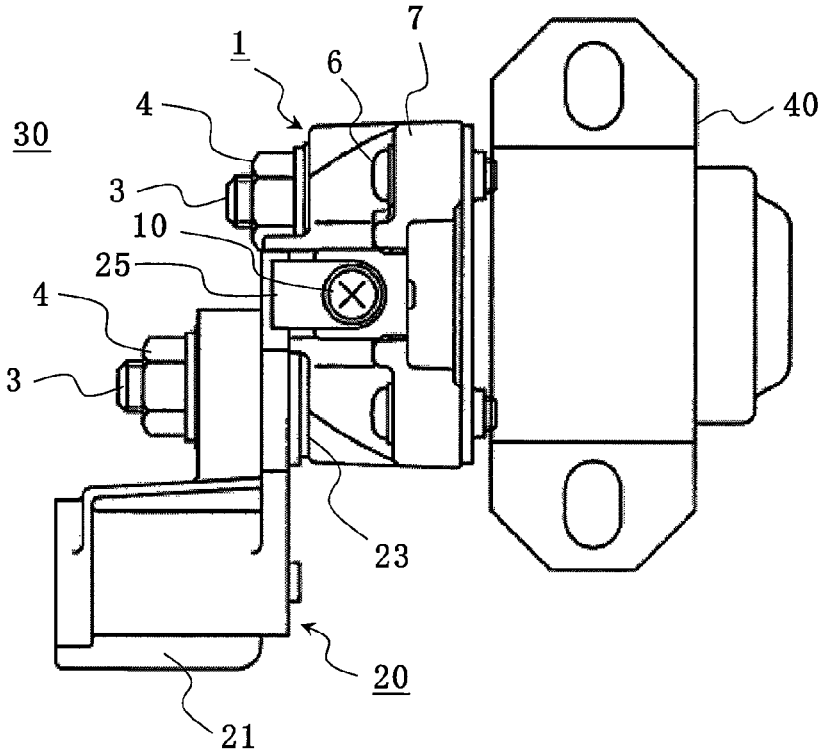
FIG. 4 is a side elevational view showing the electric relay according to the first embodiment of the present invention.

FIG. 4 is a side elevational view showing the one-pole electric relay 30 according to the first embodiment of the present invention, wherein those which are similar to the above-mentioned ones (refer to FIG. 3) are denoted by the same reference numerals and characters as those referred to above.

In FIG. 4, the contact surfaces of the bush 24 of the connector 20 and the cap 7 of the peripheral portion of the one main terminal 3 of the relay main body 1 (starter relay) are in intimate contact with each other without any gap through the packing 23, so that they are connected with each other with component parts having conductivity being not exposed. In addition, the electric relay 30 is electrically connected to a starter 40 in which a starter motor (not shown) is incorporated.

As described above, the electric relay 30 according to the first embodiment (FIG. 3 and FIG. 4) of the present invention is composed of the relay main body 1, and the connector 20 which is mounted on the relay main body 1, wherein the relay main body 1 (FIG. 1) is provided with the caps 7 that are made of a non-conductive material and have the electrical contacts (not shown) arranged therein, respectively, the exciting terminals 2 that are connected to the exciting coil (not shown) which drives the electrical contacts, and the one pair of main terminals 3 that are electrically connected to the fixed contact members of the electrical contacts, respectively.

Moreover, the connector 20 (FIG. 2) according to the first embodiment of the present invention is provided with the non-conductive member 21, the connector terminal 22 and the bush 24 that are integrally molded with the non-conductive member 21, and the terminal connection part 25 that is electrically connected to the connector terminal 22.

The terminal connection part 25 of the connector 20 is fixedly secured to one of the exciting terminals 2 of the relay main body 1, so that it is electrically connected to the exciting coil. The bush 24 of the connector 20 is fixedly secured to one of the main terminals 3 of the relay main body 1, so that it is electrically connected to the fixed contact member of one of the electrical contacts.

That is, according to the first embodiment of the present invention, by using the relay main body 1 of a conventional arrangement, in which the electrical contacts of the starter relay and the exciting coil to drive the electrical contacts are received, as it is, the one exciting terminal 2 and the one main terminal 3, which are arranged in one of the caps 7 of the relay main body 1, and the connector terminal 22 (a metal component for supplying an excitation current) and the bush 24, which are molded integrally with the non-conductive member 21 of the connector 20, are mounted or attached to each other thereby to electrically connect therebetween, so that the electric relay 30 with the connector 20 mounted thereon is constructed.

Thus, in mounting or attaching the connector 20 to the relay main body 1, by the use of fixed attachment or fastening of the one main terminal 3 and the bush 24 in addition to fixed attachment or fastening of the one exciting terminal 2 and the terminal connection part 25, it becomes possible to achieve the electric relay 30 with the connector 20 mounted thereon in a stable manner in terms of strength, with a simple structure.

In addition, by changing only the connector 20 for each specification of the electric relay 30, it becomes possible to cope with a plurality of relay specifications, and hence, it becomes unnecessary to provide an integral-type cap which is formed integrally with the connector, for exclusive use, as in the above-mentioned conventional arrangement.

That is, by changing the shape of the connector 20 alone, it is possible to obtain the electric relay 30 which can be fixedly secured or attached to the relay main body 1 in a stable manner, and so new production of caps so as to conform to each specification requirement becomes unnecessary, thus making it possible to avoid an increase in cost.

By mounting the connector 20 on the relay main body 1 with the use of the one main terminal 3 thereof, and setting the thickness of the bush 24 fixedly secured to the one main terminal 3 to be equal to or more than 3 mm, it is possible to increase the creeping distance between the one main terminal 3 and each component part, thus making it possible to achieve a specification which is excellent in leakage proofness.

Moreover, the connector 20 is provided with the packing 23 (seal member) which is arranged in the surrounding of the bottom portion of the bush 24, and the packing 23 is placed or interposed between a contact surface of the upper surface of the one cap 7 in the surrounding of the one main terminal 3 of the relay main body 1, and a contact surface of the bush 24 of the connector 20.

Thus, by using the one main terminal 3 and interposing the packing 23 between the contact surfaces in this manner, it becomes possible to mount or attach the connector 20 to the relay main body 1 without any gap, and hence the creeping distance between the one main terminal 3 and the connector 20 increases, so that the electric relay 30 can be achieved which is excellent in leakage proofness.

Further, the connector terminal 22 and the terminal connection part 25 are mutually connected and fixedly secured to each other by means of press fitting or caulking, and hence, even in cases where they are not integrally formed with each other, they can be electrically connected to each other in an easy manner.

Also, the connector terminal 22 is of the round pin type, and so, the operation of press fitting or caulking the connector terminal 22 with respect to the terminal connection part 25 can be carried out in an easy manner.

In addition, the terminal connection part 25 of the connector 20 and the one exciting terminal 2 of the relay main body 1 are fixedly secured to each other by means of screw fastening, so that they are electrically connected to each other. As a result, it is possible to ensure their stable fixed state with a simple and easy connection structure.

Second Embodiment

Figure 5:
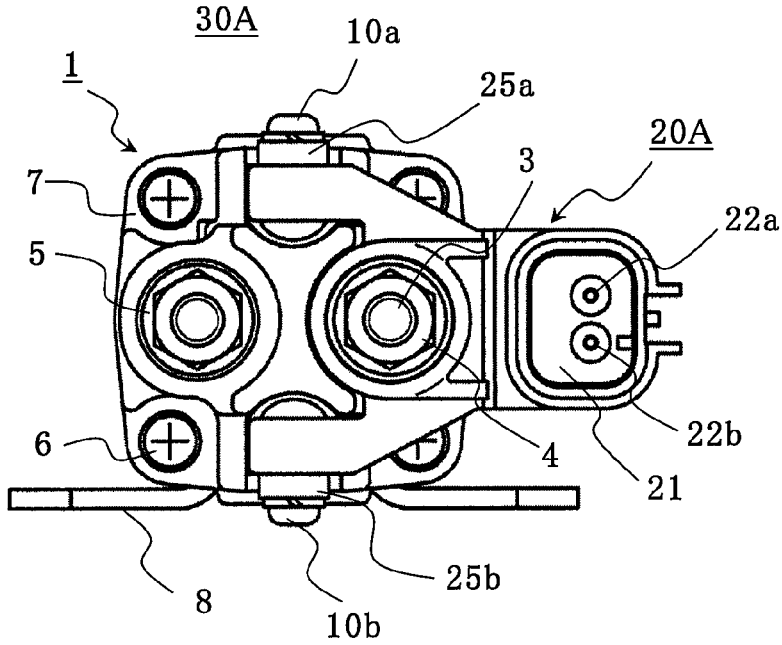
FIG. 5 is a front elevational view showing an electric relay according to a second embodiment of the present invention.

Here, note that in the above-mentioned first embodiment (FIG. 1 through FIG. 4), no specific reference has been made to modifications of the connector 20, but for example, even in the case of an electric relay 30A having two poles, as shown in FIG. 5, the present invention can deal with such a case in an easy manner by means of a modified form of connector 20A.

FIG. 5 is a front elevational view showing the electric relay 30A with two poles according to a second embodiment of the present invention, wherein the connector 20A for two poles which is connected to the relay main body 1 of FIG. 1 is shown.

In FIG. 5, those components which are similar to the above-mentioned ones (refer to FIG. 3) are denoted by the same reference numerals and characters as those in the above-mentioned embodiment, or with "A", "a", or "b" being attached to reference numerals, and a detailed description thereof is omitted.

In this case, the connector 20A is provided with connector terminals 22*a*, 22*b* of two poles, and terminal connection parts 25*a*, 25*b* of two poles.

One connector terminal 22*a* is electrically connected to one terminal connection part 25*a*, and the other connector terminal 22*b* is electrically connected to the other terminal connection part 25*b*.

In addition, the one connector terminal 22*a* and the other connector terminal 22*b* are mutually insulated from each other through a non-conductive member 21.

The terminal connection part 25*a* of the connector 20A is connected with one of exciting terminals 2 of the relay main body 1 by means of a screw 10*a*, and similarly, the terminal connection part 25*b* of the connector 20A is connected with the other exciting terminal 2 of the relay main body 1 by means of a screw 10*b*.

In addition, a bush 24 is inserted over one of the main terminals 3 of the relay main body 1, and is connected and fixedly fastened thereto by means of a nut 4, similarly as shown in FIG. 3.

As a result of this, the connector terminals 22*a*, 22*b* are electrically connected to the pair of exciting terminals 2 of the relay main body 1 (starter relay), respectively.

Also, the bush 24 is electrically connected to a fixed contact member of the relay main body 1 (starter relay) through the one main terminal 3.

As described above, according to the electric relay 30A of the second embodiment (FIG. 5) of the present invention, the relay main body 1 has the one pair of exciting terminals 2, and the connector 20A has a connector terminal element which is composed of one pair of connector terminals 22*a*, 22*b*. The connector 20A also has a terminal connection element which is composed of one pair of terminal connection parts 25*a*, 25*b* which are electrically connected to the one pair of the connector terminals 22*a*, 22*b*, respectively.

The one pair of terminal connection parts 25*a*, 25*b* of the connector 20A are electrically connected to the one pair of exciting terminals 2 of the relay main body 1, respectively, and the one pair of connector terminals 22*a*, 22*b* are mutually insulated from each other by means of the non-conductive member 21.

Thus, even in the case of the exciting terminals 2 of the relay main body 1 being two poles, it becomes possible to deal with such a case, by adding, in the connector 20A, the terminal connection part 25*b* which is hardwired or connected to the other exciting terminal 2, thereby to make the connector terminals 22*a*, 22*b* and the terminal connection parts 25*a*, 25*b* into a two-pole structure, respectively. As a result, the electric relay 30A with the two-pole connector 20A mounted thereon can be achieved in a simple manner.

Accordingly, it becomes unnecessary to use a connector with lead wires, as in the case of the afore-mentioned conventional arrangement, and hence, an electric relay can be achieved which is excellent in the aspect of layout and cost, and at the same time, cost down or reduction can be achieved.

Here, note that in this second embodiment of the present invention, too, various modifications as described in the above-mentioned first embodiment can be applied, while obtaining the same operational effects as mentioned above.

In addition, in the above-mentioned first and second embodiments, the description has been made by taking, as an example, the case where the present invention is applied to a starter relay of an engine for a vehicle, but it goes without saying that the invention can be applied to other arbitrary electric relays.

While the invention has been described in terms of preferred embodiments, those skilled in the art will recognize that the invention can be practiced with modifications within the spirit and scope of the appended claims.

What is claimed is:

1. An electric relay comprising:

a relay main body; and a connector mounted on said relay main body;

wherein said relay main body includes:

a cap that is made of a non-conductive member and has an electrical contact arranged therein;

an exciting terminal that is connected to an exciting coil which drives said electrical contact; and a pair of main terminals that are electrically connected to a fixed contact member of said electrical contact;

wherein said connector includes:

a non-conductive member;

a connector terminal and a bush that are integrally molded with said non-conductive member; and a terminal connection part that is electrically connected to said connector terminal;

wherein the terminal connection part of said connector is fixedly secured to the exciting terminal of said relay main body, so that it is electrically connected to said exciting coil; and wherein the bush of said connector is fixedly secured to one of the main terminals of said relay main body, so that it is electrically connected to the fixed contact member of said electrical contact.

2. The electric relay as set forth in claim 1, wherein the bush of said connector fixedly secured to the one main terminal of said relay main body has a thickness equal to or larger than 3 mm.

3. The electric relay as set forth in claim 1, wherein said connector is provided with a seal member that is arranged in the surrounding of a bottom portion of said bush; and said seal member is placed between a contact surface of an upper surface of said one cap in the surrounding of the one main terminal of said relay main body, and a contact surface of the bush of said connector.

4. The electric relay as set forth in claim 1, wherein said relay main body has one pair of exciting terminals;

said connector has a connector terminal element which is composed of one pair of connector terminals;

said connector also has a terminal connection element which is composed of one pair of terminal connection parts which are electrically connected to said one pair of connector terminals, respectively;

the one pair of terminal connection parts of said connector are electrically connected to the one pair of exciting terminals of said relay main body, respectively; and said one pair of connector terminals are mutually insulated from each other by means of said non-conductive member.

5. The electric relay as set forth in claim 1, wherein said connector terminal and said terminal connection part are mutually connected and fixedly secured to each other by means of press fitting or caulking.

6. The electric relay as set forth in claim 1, wherein said connector terminal is of round pin type.

7. The electric relay as set forth in claim 1, wherein said terminal connection part of said connector and the one exciting terminal of said relay main body are fixedly secured to each other by means of screw fastening, so that they are electrically connected to each other.

* * * * *